United States Patent [19]

Hunt, Jr.

[11] 4,248,396

[45] Feb. 3, 1981

[54] METHOD AND APPARATUS FOR DETECTING RAILROAD CARS

[75] Inventor: Thomas J. Hunt, Jr., Medford Lakes, N.J.

[73] Assignee: Siemens Corporation, Iselin, N.J.

[21] Appl. No.: 60,927

[22] Filed: Jul. 26, 1979

[51] Int. Cl.[3] ..... B61L 25/04

[52] U.S. Cl. ..... 246/247; 235/92 TC

[58] Field of Search ..... 246/247, 77, 1 R, 122 R, 246/34 R, 34 CT, 167 D; 235/92 TC

[56] References Cited

U.S. PATENT DOCUMENTS

| | | | |
|---|---|---|---|
| 3,486,008 | 12/1969 | Mori | 235/92 TC X |
| 3,721,820 | 3/1973 | Caulier | 246/247 |
| 3,748,443 | 7/1973 | Kroll et al. | 235/92 TC |
| 4,163,283 | 7/1979 | Darby | 235/92 TC X |

FOREIGN PATENT DOCUMENTS

| | | | |
|---|---|---|---|
| 563562 | 9/1958 | Canada | 246/77 |
| 1015037 | 9/1957 | Fed. Rep. of Germany . | |

*Primary Examiner*—Trygve M. Blix
*Assistant Examiner*—Reinhard J. Eisenzopf
*Attorney, Agent, or Firm*—Spellman, Joel & Pelton

[57] ABSTRACT

A system for detecting railroad cars in a moving train. The cars are assumed to be of the type having two wheel trucks, each with at least two axles arranged adjacent to each other such that the maximum distance between the axles of a single truck is less than the center distance between facing axles of two trucks of a single car. The system includes a device for measuring the distance between successive axles as a train of cars moves in one direction along a track, a device for comparing each measured distance with the maximum axle distance for a truck, and a device for determining whether the axle spacing of a first truck equals the axle spacing of a second truck after the maximum axle distance for a truck has been exceeded. In this way, an individual car is detected upon identification of two identical truck assemblies which are separated by an axle spacing that is greater than the maximum permissible axle distance in a truck.

15 Claims, 22 Drawing Figures

| | MEASUREMENT "A" | MEASUREMENT "B" | MEANING |
|---|---|---|---|
| 1 | 54 | 50 | TRUCK ONLY |
| 2 | 58 | 54 | |
| 3 | 69 | 65 | |
| 4 | 73 | 69 | |
| 5 | 84 | 80 | TRUCK OR COUPLING |
| 6 | 88 | 84 | |
| 7 | 99 | 95 | |
| 8 | 103 | 99 | |
| 9 | 114 | 110 | COUPLING ONLY |
| 10 | 118 | 114 | |
| 11 | 129 | 125 | |
| 12 | 133 | 129 | |
| 13 | 144 - 147 | 139 - 143 | |
| 14 | 147 - 157 | 143 - 147 | COUPLING OR CAR CENTER |

FIG. 8

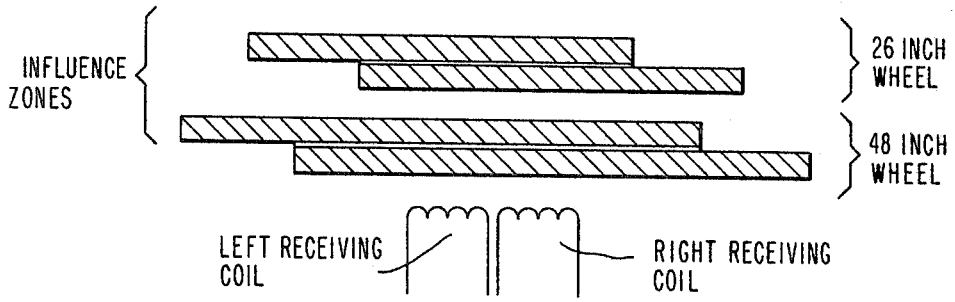
FIG. 11
| DIRECTION OF CAR | SIGNAL SEQUENCE |
|---|---|
| → | LEFT, BOTH LEFT & RIGHT, RIGHT |
| ← | RIGHT, BOTH RIGHT & LEFT, LEFT |
FIG. 12
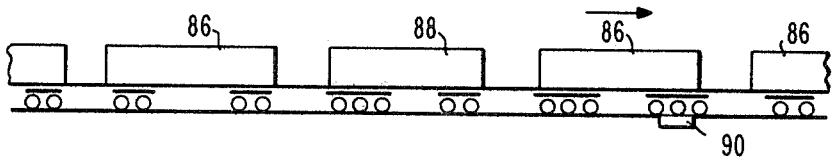
FIG. 14A
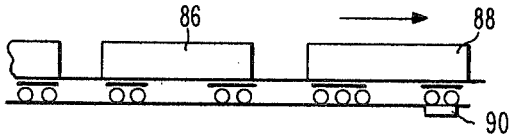
FIG. 14B

| FIG. 16A | FIG. 16B |
|---|---|

METHOD AND APPARATUS FOR DETECTING RAILROAD CARS

BACKGROUND OF THE INVENTION

The present invention relates to a system for detecting or identifying individual railroad cars as they move in a train along a track. More particularly, the present invention relates to a system for detecting railroad cars which have no label, stripe, transponder or other means of identification.

The term "railroad car", as used herein, is defined as any type or rolling railroad stock such as, but not limited to, a locomotive, box car, tank car, ore car, flat car, caboose and passenger car.

Various techniques have been employed to detect and count moving railroad cars. One such technique is to simply count the number of axles in a train and to assume that each car in the train has a certain number of axles (four, for example). Such a system is useful in situations where only one type of car, such as an ore car, is being counted but it cannot be employed when the types of cars may vary.

Another car-detecting technique, which distinguishes between two types of railroad cars, is disclosed in the German patent publication (DAS) No. 1,015,037. In this system, the distance between the axles of two-axle cars provides a criterion for differentiating between cars. Wheel sensors, arranged along the track, are coupled to an electronic switching network which determines whether the car is of one type or another.

Other car-detecting techniques are known which require some form of identification on each railroad car. For example, the car may be provided with a painted "stripe" at a particular level which is optically scanned as the car passes by. Each car may also be provided with a transponder that transmits a unique identification code in response to an interrogation from a stationary transmitter arranged adjacent to the track.

None of the systems described above are capable of accurately detecting the presence of railroad cars in a train (1) without prior knowledge of the type of cars in the train, and/or (2) without some means of identification arranged on each car.

SUMMARY OF THE INVENTION

It is an object of the present invention to provide a system (method and apparatus) for accurately detecting railroad cars of random type which have no label, transponder or other means of identification.

This object, as well as other objects which will become apparent in the discussion that follows, are achieved according to the present invention, by assuming that each railroad car in a train has two weight-bearing wheel trucks disposed beneath it at opposite ends, with each truck having at least two axles arranged adjacent to each other such that the maximum distance between the axles of a single truck is less than the center distance between facing axles of the two trucks of the car. With this assumption, which applies to 98% of all railroad cars in the United States, individual cars may be detected by identification of two identical truck assemblies which are separated by an axle spacing that is greater that the maximum axle distance in a truck. This may be accomplished by measuring the distance between successive axles as a train of cars moves in one direction along the track; comparing the measured distance with the maximum axle distance for a truck; and determining whether the axle spacing(s) of a first truck equals the axle spacing(s) of a second truck after the maximum axle distance for a truck has been exceeded.

The present invention therefore contemplates a car detection method, as well as car detection apparatus which operates to carry out this method.

The car detection system according to the present invention is based on the following principles:

(1) As noted above, the maximum distance between axles of a single truck is normally less than the center distance between facing axles of the same car. In this way, it is possible to identify the end of the first truck of a car as it passes by and, therefore, the beginning of the second truck.

(2) With few exceptions, the axle locations of a railroad car are symmetrical with respect to the car center. As a result, it is possible to identify the two trucks of a car by matching their respective axle spacing(s).

BRIEF DESCRIPTION OF THE DRAWINGS

FIG. 8 is a chart of the various wheel distance measurements which may be taken with the sensors in the configuration shown in FIG. 7.

FIG. 11 is a diagram showing how the wheel influence zones overlap in the wheel sensing system of FIG. 5.

FIG. 12 is a chart illustrating how the direction of movement of a railroad car may be determined with the wheel sensing system of FIG. 5.

FIGS. 14*a* and 14*b* are schematic diagrams of trains of railroad cars, illustrating how an unsymmetrical car may be detected and counted.

DESCRIPTION OF THE PREFERRED EMBODIMENTS

Figure 1:
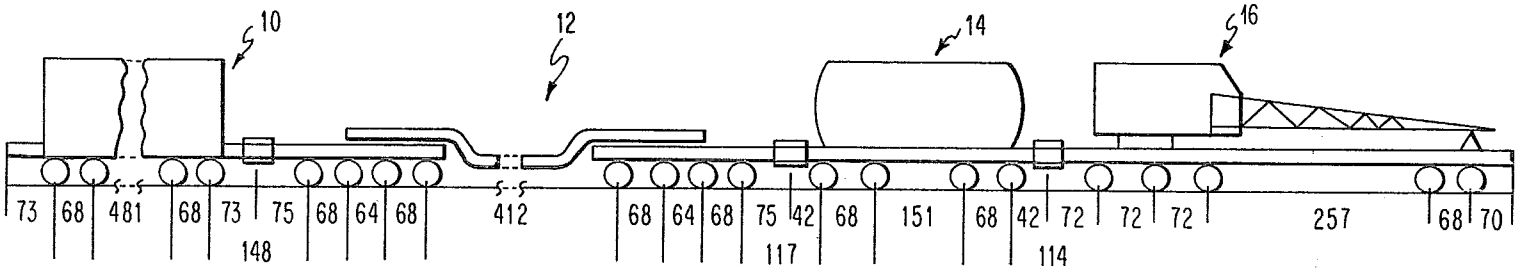
FIG. 1 is a side view of a railroad train showing four different types of railroad cars.

The preferred embodiments of the present invention will now be described with reference to FIGS. 1–16 of the drawings. Identical elements in the various figures are designated with the same reference numerals.

FIG. 1 shows an exemplary train of railroad cars with typical axle spacing distances indicated in inches. It will be noted that the left car 10 of the train has two trucks having two axles each. The axle spacing in each truck is 68 inches, whereas the center axle spacing between the two trucks is 481 inches. The next car 12 in the train has two trucks with axle spacings of 68, 64 and 68 inches, respectively. The center distance between the inside axles of the two trucks is 412 inches.

The distance between the closest axles on the adjacent trucks of cars 10 and 12 is 148 inches. This distance is the sum of the axle-to-coupling distance of car 10 (73 inches) and the axle-to-coupling distance of car 12 (75 inches).

The next car 14 in the train has two trucks with two axles each. The car 16 at the right has two trucks; in this case one truck has three axles and the other has two. This car is unsymmetrical due to the nature of its payload.

The inter-axle dimensions indicated in FIG. 1 are typical of railroad cars in the United States. The actual dimensions and specifications for all known cars may be obtained from one or more of the following texts: *Car and Locomotive Cyclopedia of American Practices* by Simmons, Boardman Publishing Corp. (1974); *Wheel and Axle Manual,* 11th Ed., effective Oct. 1, 1975, published by the Association of American Railroads, Washington, D.C.; and *The Official Railway Equipment Register,* Vol. 92, No. 3, effective Jan. 20, 1977 by the National Railway Publication Company, New York, N.Y.

Figure 2:
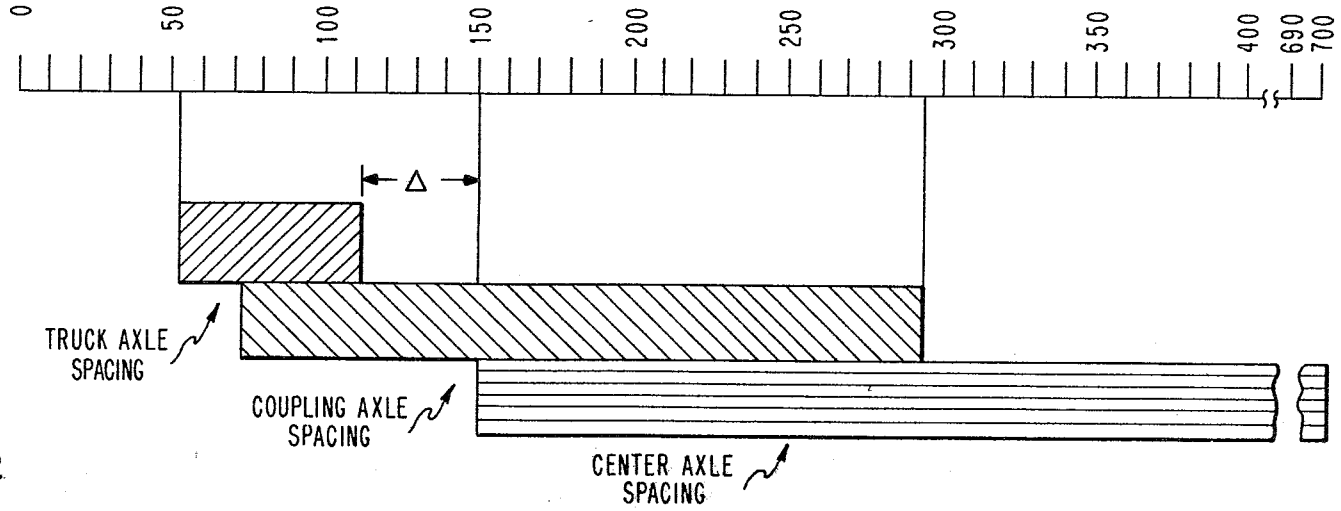
FIG. 2 is a graph showing the axle spacing between (1) adjacent axles within a single truck, (2) adjacent trucks on different, coupled cars, and (3) two trucks on the same car.

FIG. 2 shows the range of relevant inter-axle distances for all railway cars in the United States. Similar graphs may be made for railway cars of other nations. As may be seen in the graph, the axle spacings within a truck range from 54 to 112 inches; the axle spacings between trucks on opposite sides of a coupling range from 73.5 to 295 inches; and the axle spacings between inside axles of individual cars (the center axle spacings) range from 151 to 700 inches. Thus, it may be seen that while the coupling axle spacings overlap the center axle spacings as well as the truck axle spacings, the center axle spacings and the truck axle spacings do not overlap. There is a difference range, indicated in FIG. 2 by "Δ", between 112 and 151 inches in which the axle spacing can only be the coupling axle spacing from one car to the next. This difference Δ makes it possible to distinguish between truck and center axle spacings on any given car.

Figure 3:
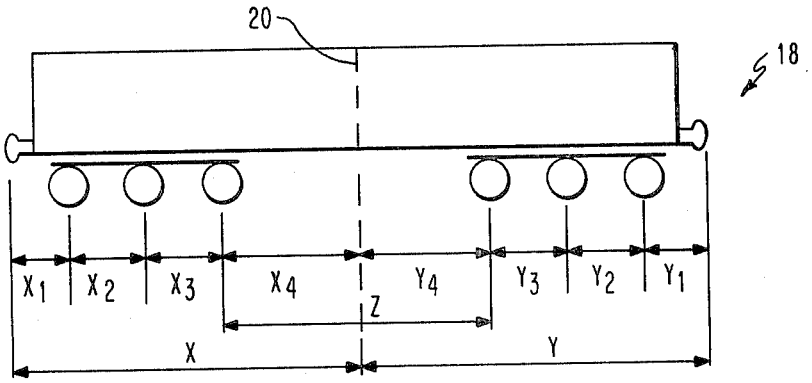
FIG. 3 is a diagram of a railroad car showing the typical symmetry.

FIG. 3 shows a typical railroad car 18 which is symmetrical about a center line 20. Such symmetry is characteristic of 98% of the cars in the United States.

From the symmetry it follows that:

$X1=Y1,$ $X2=Y2,$ $X3=Y3,$ $X4=Y4,$ and $X=Y,$ where X1 and Y1 are the contributions of the car 18 to the coupling axle spacing; X2, Y2, X3 and Y4 are the truck axle spacings and $X4+Y4=Z$ is the center axle spacing.

Figure 4:
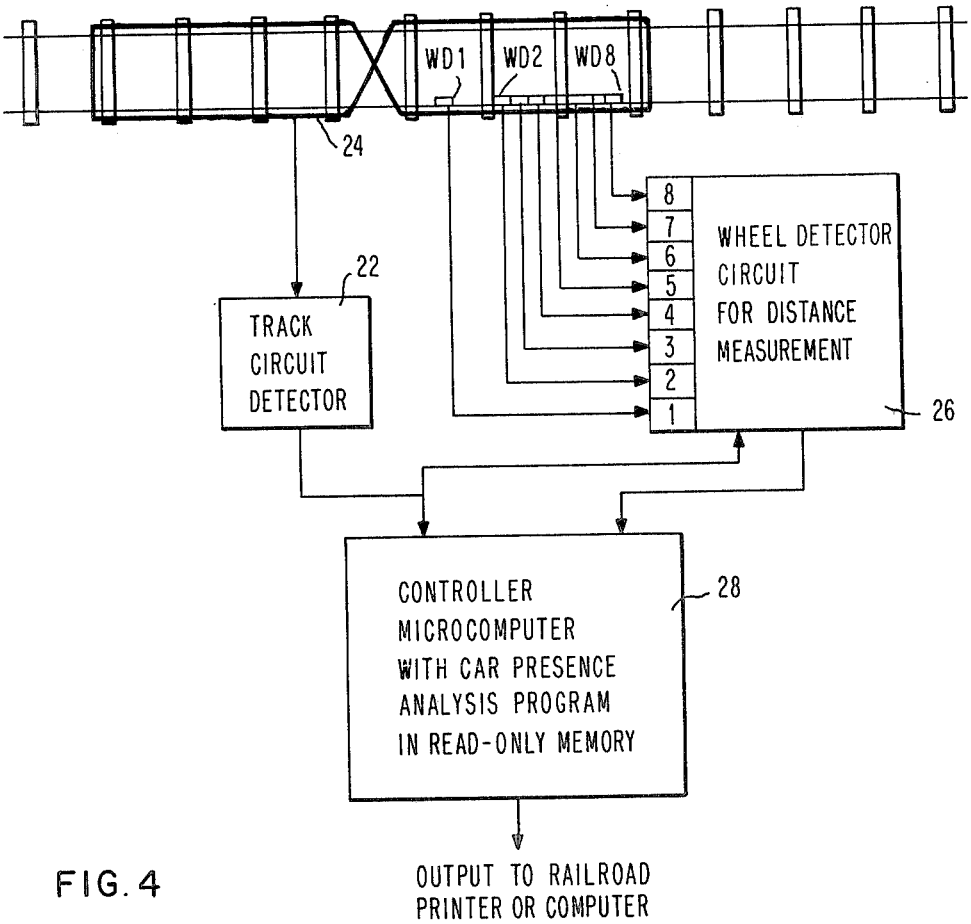
FIG. 4 is a block diagram of a first preferred embodiment of apparatus, according to the invention for detecting railroad cars.

FIG. 4 is a block diagram of one preferred embodiment of the apparatus according to the present invention. This embodiment includes a conventional track circuit detector 22 which detects variations in a voltage across a twisted coil 24 thereby to determine the presence of a train. When a train is present, the track circuit detector sends a signal to a wheel detector array 26 and to a microcomputer 28 to activate and reset these circuits. The wheel detector circuit 26 cooperates with eight wheel detector sensors WD1, WD2, . . . WD8 to determine the distance between adjacent wheels (axles) which pass over the track. The wheel detector circuit sends these distance measurements, in parallel form, to the controller microcomputer 28 which has a car presence analysis program in a read-only memory. The microcomputer 28 analyzes the measurements received from the wheel detector circuit 26, in a manner described hereinbelow, and counts and accumulates the number of cars passing over the track at sensors WD1–WD8. On command, or after the track circuit detector 22 indicates that the train has passed, the total number of cars in the train is output to a railroad printer or to another computer.

Figure 5:
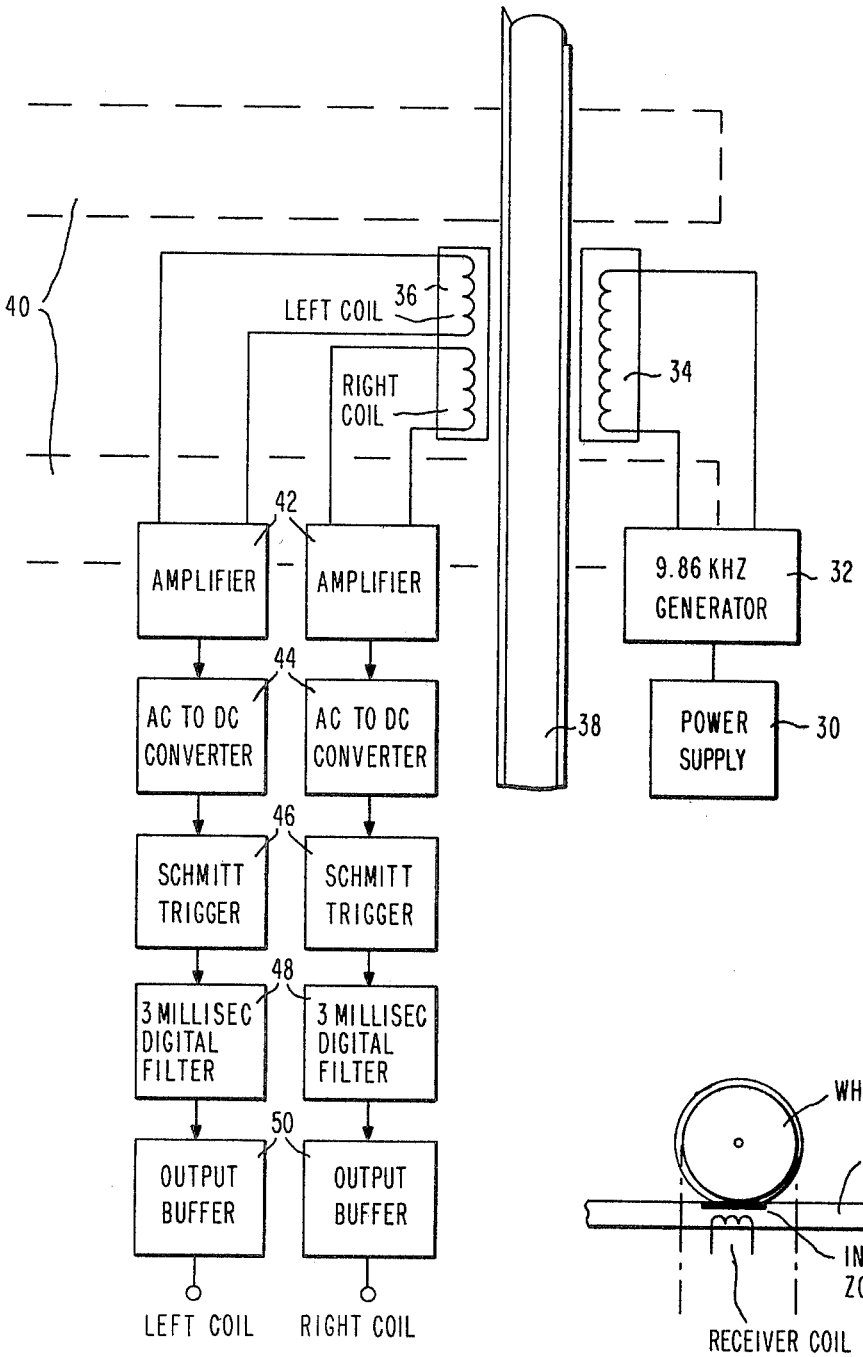
FIG. 5 is a block diagram of a wheel sensor used in the apparatus of FIG. 4.

FIG. 5 shows the wheel detector sensor and circuit employed in the preferred embodiment of the present invention. Such a wheel detector is available commercially from Siemens Corp. Iselin, N.J. The wheel detector sensor comprises a power supply 30, a 9.86 KHz sine wave generator 32, a transmitting coil 34, and two receiving coils 36. The transmitting coil and receiving coils are arranged on opposite sides of a railroad track 38 between two railroad ties 40. The transmitting coil 34 is continuously excited by a 9.86 KHz sine wave; inductive coupling between the transmitter and receiver coils causes a similar signal to be induced in the receiver coils 36 and passed to amplifiers 42. The AC signal is rectified in AC-to-DC convertors 44 and passed to Schmitt triggers 46 which produce signals at their outputs if their input signals exceed a certain threshold. These output signals are filtered by digital filters 48 to eliminate pulses shorter than 3 milliseconds and then passed to output buffers 50 which may be one-shot multivibrators.

Figure 6:
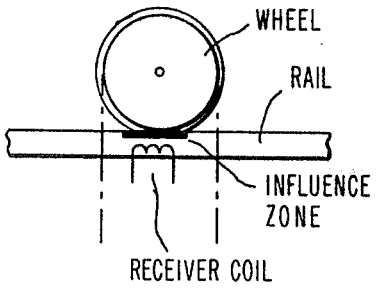
FIG. 6 is a diagram showing the influence zone of a railroad wheel in the wheel sensor of FIG. 5.

As shown in FIG. 5, the wheel detector provides a left sensor and a right sensor, the centers of which are four inches a part in practice. Each sensor operates to indicate the presence of a railroad car wheel when the wheel is within a certain region called an "influence zone". FIG. 6 depicts such an influence zone which varies between 13.9 inches for a 26 inch wheel and 18.2 inches for a 48 inch wheel. The common 33 inch wheel size has an influence zone of 15.7 inches. Although there would be a 4.3 inch "error" if a car having 26 inch wheels is coupled to a car having 48 inch wheels, this error is of little significance because the coupling distance between two cars is normally greater than the axle spacing on a truck having 48 inch wheels. That is, the larger the wheel, the greater the truck-to-coupling distance.

Figure 7:
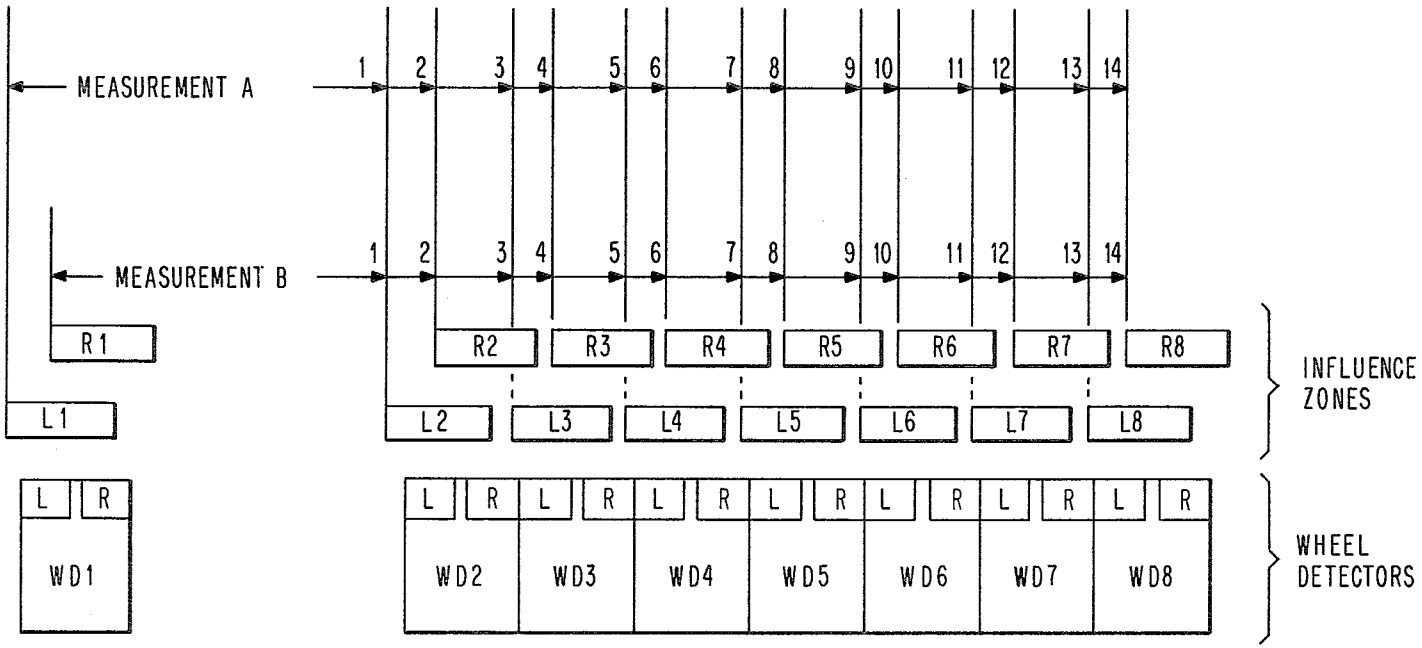
FIG. 7 is a diagram showing the wheel distance measurements which are made with the apparatus of FIG. 4.

FIG. 7 illustrates the placement of the eight wheel detectors in the preferred embodiment of the present invention. The indicated measurements are taken when a wheel encounters the left and right influence zones of the wheel detector WD1. The output of the wheel detector (WD2–WD7) which is closest to WD1 is taken as the distance measurement to the closest wheel.

Thus, when a wheel encounters WD1-left, a reading is taken of WD2 through WD7. The lowest reading is taken as the distance to the next wheel. Four inches later, when the wheel encounters WD1-right, a second reading is taken of WD2 through WD7. These two readings are stored in memory for each wheel passing WD1. As these wheel distance measurements are being stored, a car presence program in the control microprocessor 28 performs an analysis of the data.

FIG. 8 shows the actual measurements which may be taken with the wheel detector arrangement of FIG. 7. Measurement "A" is taken from the beginning of the influence zone of the left sensor of WD1, whereas measurement "B" is taken from the beginning of the influence zone of the right sensor of WD1. The actual inch dimensions of the measurements A1–A14 and B1–B14 are given. By comparison of these measurements with the graph of FIG. 2, conclusions may be drawn from these different measurements. These conclusions are shown in the right-hand column of FIG. 8.

Figure 9:
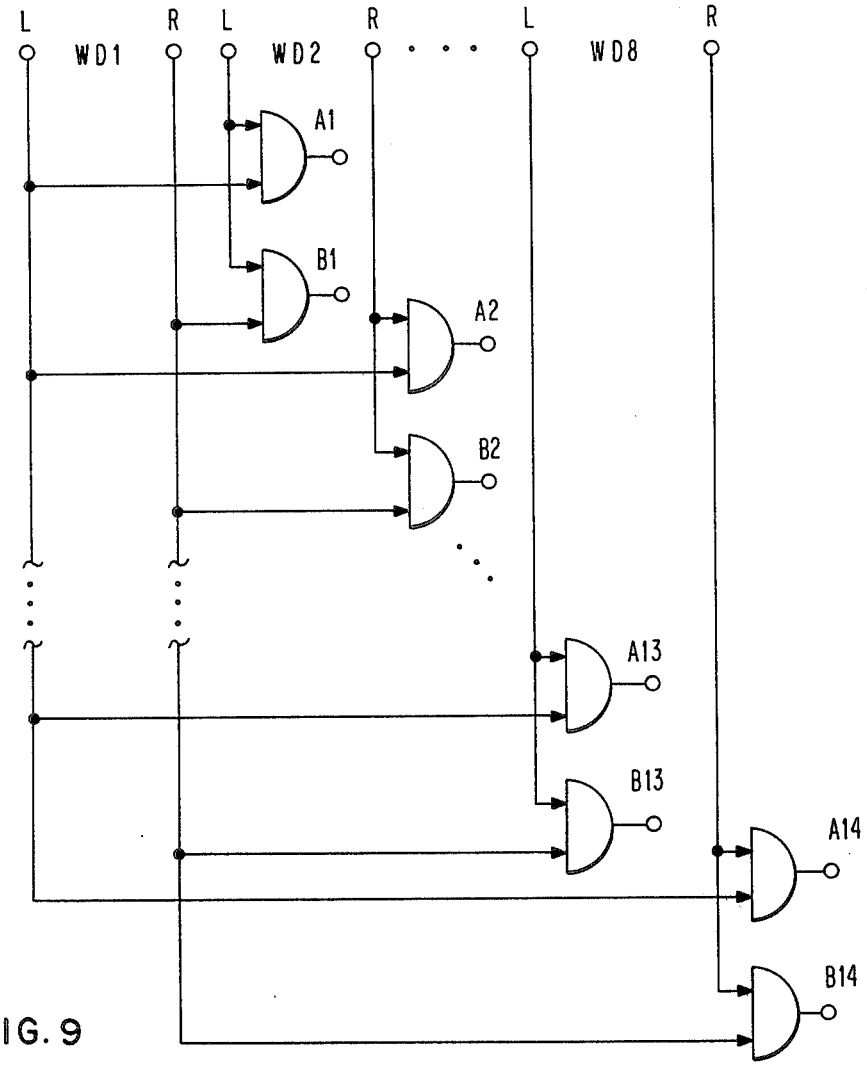
FIG. 9 is a schematic diagram of a circuit providing signals representing the wheel distance measurements of FIG. 8.

FIG. 9 is a schematic diagram showing how the outputs of the eight wheel detectors are connected together to indicate the measurements A1,B1,A2,B2 . . . A14,B14. As is shown, the circuit produces these respective outputs upon coincidence of a signal from the left (measurement "A") or right (measurement "B") sensor of WD1 and a signal from the respective left or right sensor of WD2–WD8. The outputs A1,B1 . . . A14,B14 from the circuit of FIG. 9 may be encoded into a five-bit binary number and this number passed in parallel to the controller microcomputer 28.

Figures 10, 10B:
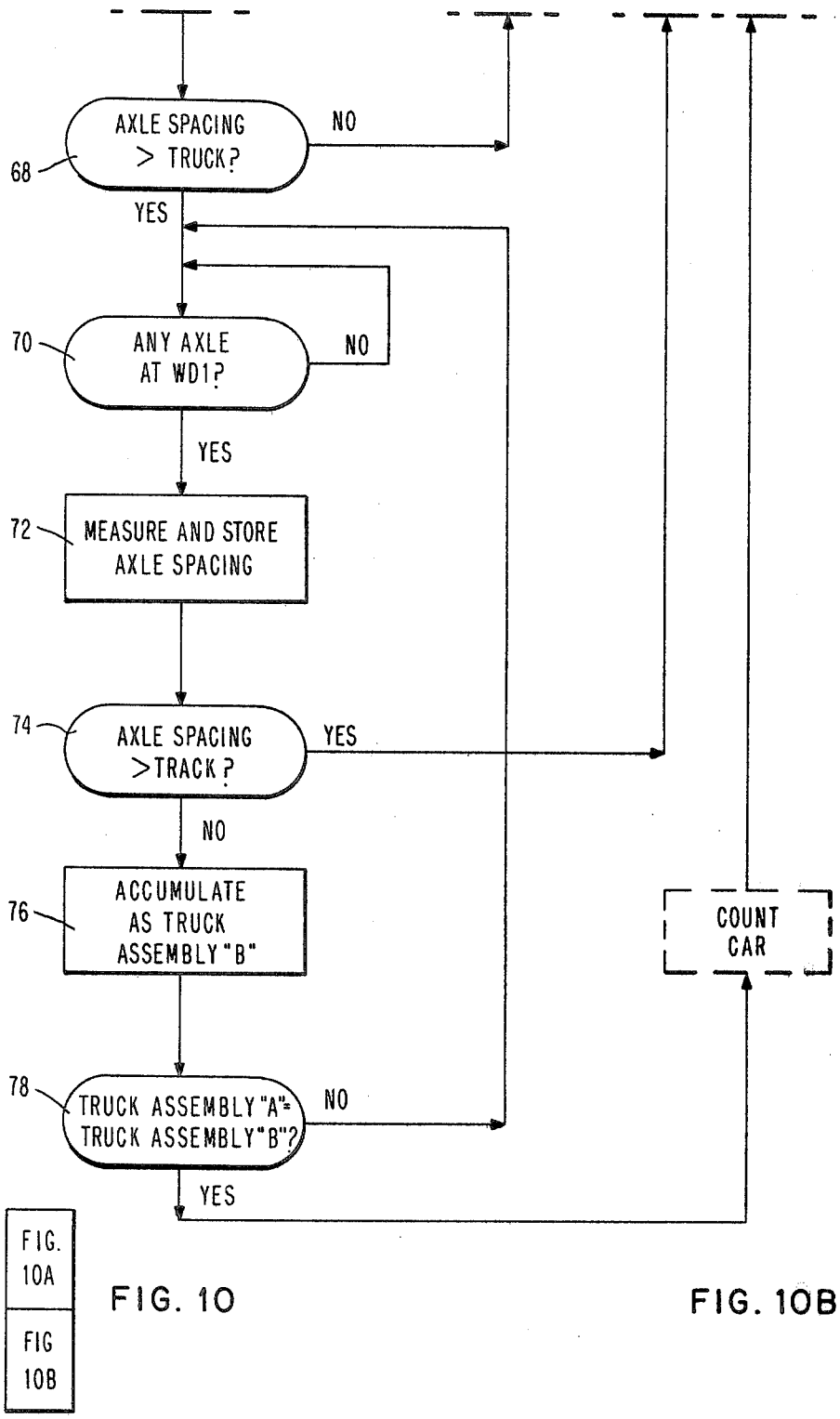
FIG. 10 (FIG. 10A and 10B) is a flow chart of a car presence analysis program usable with the controller microcomputer in the apparatus of FIG. 4.
Figure 10A:
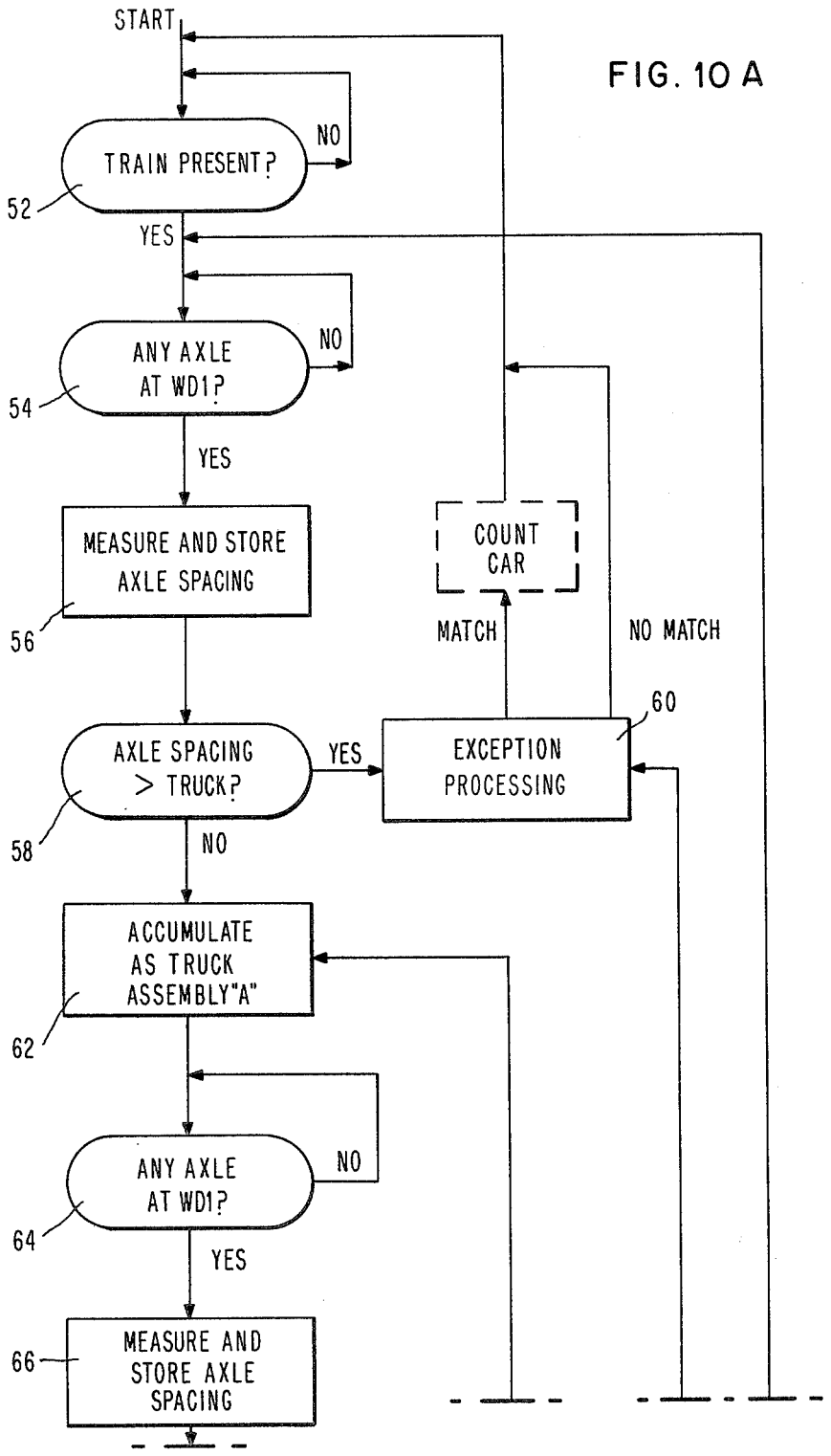

FIG. 10 is a flow chart of the car presence analysis program of the controller microcomputer 28. In this program the first block determines if a train is present at the wheel detecting station (block 52). In actual practice, the program tests to see if a latch has been set by the track circuit detector 22. While the presence of a train is only checked at the outset in the flow chart of FIG. 10, it would be advantageous if the presence of a train were checked repeatedly throughout the program to correct a possible error in the system and to prevent the program from waiting indefinitely for further information when, in fact, a train has passed.

If a train is present, the program tests for the presence of a wheel (axle) at WD1 (block 54). When an axle is present at WD1, the axle spacing is stored (block 56) and this spacing is checked to determine whether it is greater than the spacing of axles within a truck (i.e., greater than 112 inches). If so, the program has detected a car with a single, stand-alone axle and control is passed to a program routine called "Exception Processing" (block 60). In this routine, the program compares all the available information about the axle spacings of the current car with the axle spacings of all unsymmetrical railroad cars. If a car is found or if a match cannot be made, control is returned to the beginning of the program.

If the axle spacing checked in block 58 is not greater than the truck axle spacing, this axle spacing is accumulated as truck assembly "A" (block 62). The program then awaits the next axle at WD1 (block 64) and measures and stores the next axle spacing (block 66). This axle spacing is compared to the truck axle spacing (block 68) and, if it is less, it is accumulated as truck assembly "A". If it is greater than the truck axle spacing, it is probably a center spacing and the program awaits the next measurement (block 70). The next axle spacing which is measured and stored (block 72) is passed to Exception Processing if it is greater than the truck axle spacing (block 74) and accumulated as truck assembly "B" (block 76) if it is less than the truck axle spacing. Thereafter, the axle spacings of truck assembly "A" are compared with those in truck assembly "B" (block 78). If the number of axle spacings and/or their value do not match, the program returns to block 70 and awaits the next axle spacing. If the two truck assemblies do match, a car is counted and control is returned to the beginning of the program.

The operation of the car analysis program according to the flow chart of FIG. 10 will now be described by way of example illustrated by the train in FIG. 1. Assume that this train is travelling from left to right in the sense of the figure so that the car 16, which is unsymmetrical, is detected first. The information relating to this grouping of cars is set forth in the following Table I:

TABLE I

| SEQUENCE | Measurements A | Measurements B | MEANING | ACTUAL |
|---|---|---|---|---|
| 1 | 2 | 3 | Truck | 68 |
| 2 | N | N | Coupling/Center | 257 |
| 3 | 3 | 4 | Truck | 72 |
| 4 | 3 | 4 | Truck | 72 |
| 5 | 9 | 10 | Coupling/Center | 114 |
| 6 | 2 | 3 | Truck | 68 |
| 7 | 14 | N | Coupling/Center | 151 |
| 8 | 2 | 3 | Truck | 68 |
| 9 | 9 | 10 | Coupling | 117 |
| 10 | 2 | 3 | Truck | 68 |
| 11 | 2 | 2 | Truck | 64 |
| 12 | 2 | 3 | Truck | 68 |
| 13 | N | N | Coupling/Center | 412 |
| 14 | 2 | 3 | Truck | 68 |
| 15 | 2 | 2 | Truck | 64 |
| 16 | 2 | 3 | Truck | 68 |
| 17 | 14 | 14/N | Coupling/Center | 148 |
| 18 | 2 | 3 | Truck | 68 |
| 19 | N | N | Coupling/Center | 487 |
| 20 | 2 | 3 | Truck | 68 |
| 21 | N | N | Coupling/Center | 68 |

NOTE: "N" denotes > 151 inches (12'7")

Table I has a sequence number which references the wheels of FIG. 1 as they encounter the measurement area. The measurements "A" and "B" may be translated into inches using the chart of FIG. 8. The car analysis program is not interested in the inch measurements, however, but only in the relative reading and the truck coupling/center boundary indicated in FIG. 8.

The program actually stores the information indicated in the following Table II until a comparison is determined or exception processing has determined a car. Table II information illustrates the continuous movement, however when a car has been counted, the current information is cleared and the process starts over.

TABLE II

| | | | | |
|---|---|---|---|---|
| (1) | T | (2,3) | --------- | |
| (2) | C | N,N | | UNEQUAL |
| (3) | T | (3,4) | --------- | |
| (4) | T | (3,4) | --------- | |
| (5) | C | 9,10 | EXCEPTION PROCESSING CAR 16 | |
| TABLE CLEARED | | | | |
| (1) | T - | (2,3) | --------- | |
| (2) | C - | 14,N | | EQUAL |
| (3) | T - | (2,3) | --------- | |
| (4) | C - | 9,10 | | CAR 14 |

TABLE II-continued

| | | | | |
|---|---|---|---|---|
| TABLE CLEARED | | | | |
| (1) | T - | (2,3) | --------- | |
| (2) | T - | (2,2) | --------- | |
| (3) | T - | (2,3) | --------- | |
| (4) | C - | N,N | EQUAL | |
| (5) | T - | (2,3) | --------- | |
| (6) | T - | (2,2) | --------- | |
| (7) | T - | (2,3) | --------- | |
| (8) | C - | 14,N | | CAR 12 |
| TABLE CLEARED | | | | |
| (1) | T - | (2,3) | --------- | |
| (2) | C - | N,N | EQUAL | |
| (3) | T - | (2,3) | --------- | |
| (4) | C - | N,N | | CAR 10 |
| TABLE CLEARED | | | | |

While direction determination has not been stressed heretofore, it will be understood that the car counting system according to the present invention will process a train moving in either direction and even if it changes direction. Direction reversal will remove values from the stored table until the table is empty. New values will then be stored and the new direction will be noted for the purpose of decrementing the total count of the train. Since the table will contain information pertaining to only one car at one time, each car appears as the only car to the controller microcomputer.

Figure 13:
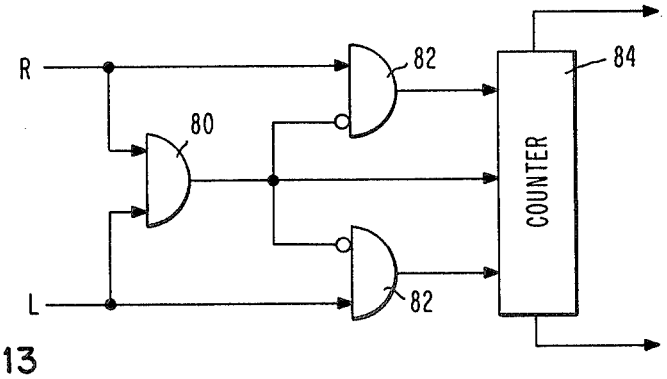
FIG. 13 is a schematic diagram of a circuit providing signals representing the direction of movement of a railroad car.

FIGS. 11,12 and 13 illustrate how the wheel detecting array in FIG. 4 may be used to monitor changes of direction. As mentioned previously, each wheel detector has a left and a right sensor. The influence zones for each sensor are from 13.9 inches for a 26 inch wheel to 18.2 inches for a 48 inch wheel. There is thus an overlap in influence zones as shown in FIG. 11.

FIG. 12 shows the signal sequence of a wheel detector in dependence upon the direction of wheel movement. Since the signal sequences are different for right and left movement, it is possible to determine the movement direction by means of a simple circuit such as that shown in FIG. 13.

The circuit of FIG. 13 comprises an and-gate 80, two not-and-gates 82 and a three state counter 84. Each of the three inputs to the counter 84 places it in a separate state. The counter is constructed so that it cannot move from one end state to the other without passing through the center state. The outputs of the counter indicate the direction of movement. In this way, a wheel will be counted as passed only if it has gone through a complete left to right movement or a complete right to left movement. In addition, the stored values of axle spacing will not be allowed to change if the detected wheels have no net movement. These values are simply held in temporary storage until net movement occurs.

FIGS. 14A and 14B illustrate the operation of the system when an unsymmetrical car is encountered. FIG. 14A shows a train of cars comprising symmetrical cars 86 and one unsymmetrical car 88. As previously noted, the car presence analysis program will clear stored axle spacing values when a car has been determined and counted. Therefore, any unusual, unsymmetrical car will appear as the first or only car as it enters the detection point on the track. Thus, when the car 88 enters the wheel detector array 90 and the initial axle spacing is determined, the axle spacing values of the previous car will have already been cleared from memory and the train will appear as in FIG. 14B as if the unsymmetrical car were the first or only car in the train. This car will subsequently be detected by: (1) determining that the car is not symmetrical and (2) identifying the car by its axle spacing "signature"; that is, its unique combination of axle spacings.

Figure 15A:
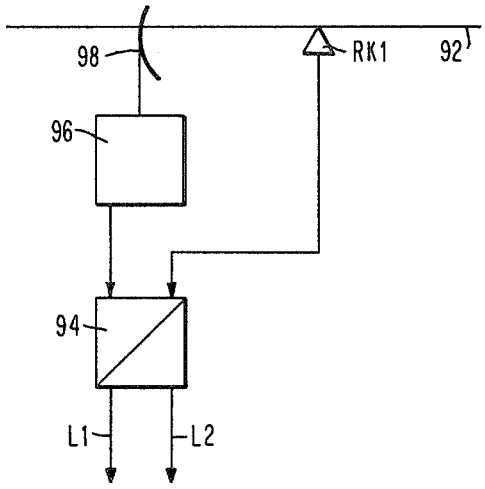
FIGS. 15*a* and 15*b* are schematic diagrams of alternative embodiments of apparatus for detecting the spacing between the adjacent axles of railroad cars.
Figure 15B:
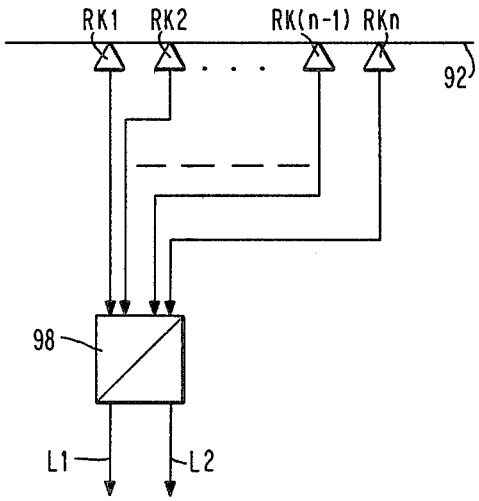

FIGS. 15A and 15B show two further alternative embodiments of devices for detecting car axle spacing. 15A shows a track 92 adjacent to which is arranged a rail contact RK1. A converter 94 registers the time between the actuations of the rail contact RK1 by the wheels of a passing train. The converter 94 also receives a signal representative of the speed of the train from a speed measuring device 96. This speed measuring device has an antenna 98 and uses radar to determine the speed of the passing train. The converter 94 determines, on the basis of time and speed, the spacing between successive axles.

Figure 16A:
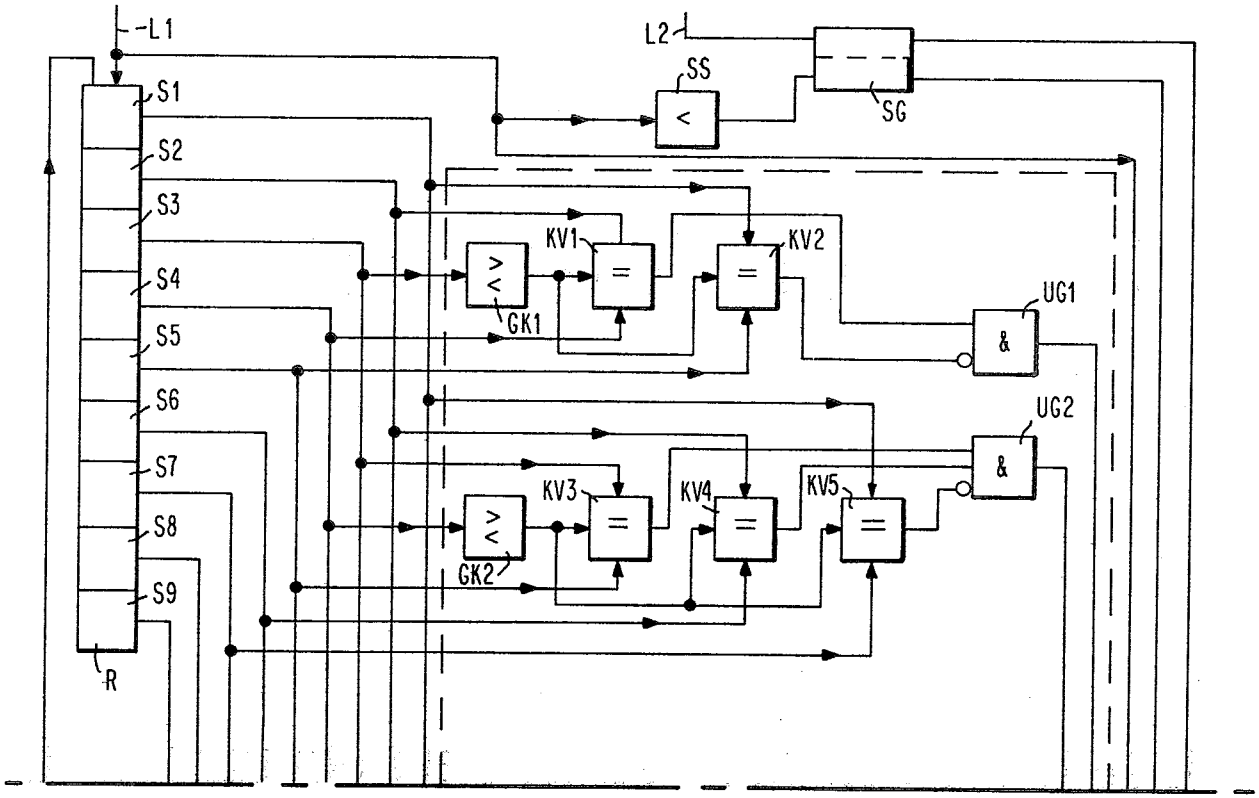
FIGS. 16 (FIG. 16A and 16B) is a block diagram of a second preferred embodiment of apparatus, according to the invention, for detecting railroad cars.
Figures 16, 16B:
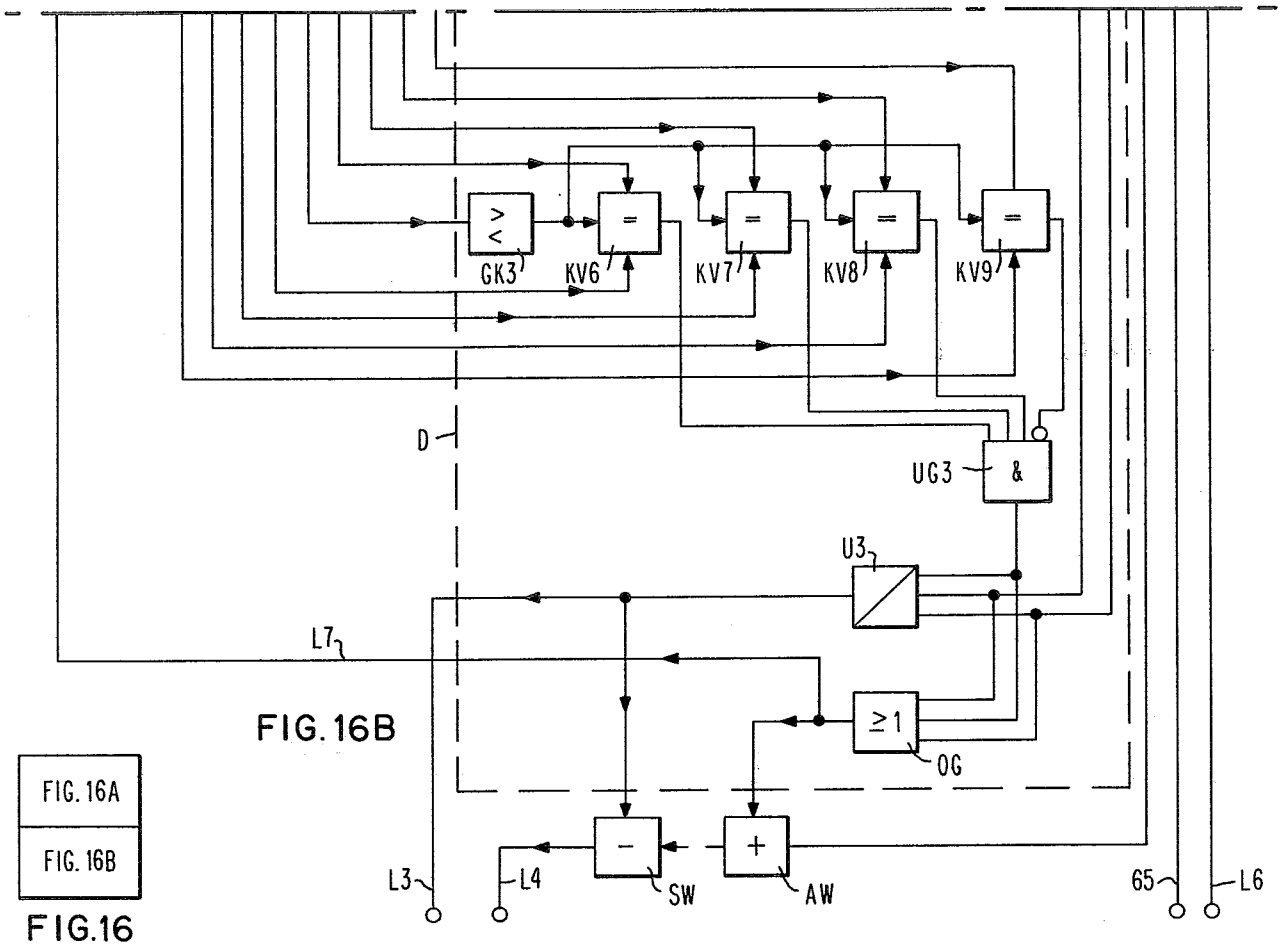

A signal corresponding to the determined spacing is sent via a line L1 to a programmed microcomputer or to a car presence analysis circuit such as that shown in FIG. 16. In addition, the converter 94 sends a further signal on line L2 to the microcomputer or analysis circuit whenever the spacing between successive axles exceeds a prescribed maximum distance which is greater than the largest possible center axle spacing-for example, 700 inches for railroad cars in the United States. Such a distance between axles, which exceeds the maximum spacing, will always exist between the last axle of a first train of cars and the first axle of a succeeding train of cars.

FIG. 15B shows an axle spacing measurement device comprising a series of rail contacts RK1, RK2 . . . RK(n−1), RK(n) which permit the direct determination of wheel or axle spacing. In this case, another converter 98 receives the signals from the rail contacts and produces signals, on lines L1 and L2, respectively, in dependence upon the determined spacing or the existence of an axle spacing exceeding the prescribed maximum.

FIG. 16 shows a hardwired circuit adapted to receive the signals on lines L1 and L2 and produce outputs on lines L3, L4, L5 and L6 as explained below.

The axle spacings presented on line L1 are supplied to a register R. As each axle spacing is determined, it is read into a first storage location S1. As each newly determined axle spacing is presented, the previously supplied information is shifted to the next storage location S2,S3, . . . S9, respectively.

A larger/smaller comparator GK1 is connected to the storage location S3. When the axle spacing in storage location S3 falls within the expected tolerance range for a center axle spacing (i.e., between 151–700 inches) it furnishes a control signal to a coincidence comparator KV1 and to a coincidence comparator KV2. These comparators test for coincidence of the contents of storage locations S2 and S4 as well as S1 and S5. Whenever storage points S2 and S4 contain identical axle spacings, and storage points S5 and S1 unequal axle spacings, a signal is released via the and-gate UG1, indicating a four axle car. A converter U3 responds to this signal and produces an encoded signal on line L3 indicating this particular type of car.

A larger/smaller comparator GK2 is connected to storage location S4. This comparator corresponds to the larger/smaller comparator GK1, but checks for a center axle spacing of a six axle car. Coincidence comparators KV3, KV4 and KV5, in turn, check the contents of storage locations S3 and S5, S2 and S6 and S1 and S7, respectively, for coincidence. If coincidence comparators KV3 and KV4 indicate a coincidence, and comparator KV5 indicates no coincidence, then a six axle car has been detected. When an and-gate UG2 produces a signal indicating this condition, the code converter U3 produces an encoded signal indicating a six axle car.

Finally, an eight axle car can be detected by a larger/-smaller comparator GK3 connected to the storage point S5 and by four coincidence comparators KV6, KV7, KV8 and KV9 which compare the contents of storage locations S4 and S6, S3 and S7, S2 and S8, and S1 and S9. An eight axle car produces a coincidence in coincidence comparators KV6, KV7 and KV8 and no coincidence in the comparator KV9. This condition is indicated by the output of the and-gate UG3 which is passed to the code converter U3. The converter U3 then produces an encoded signal indicative of an eight axle car.

Each time a car is detected, an or-gate OG produces a signal on line L7 clearing the register R and returning it to its initial state.

For the sake of clarity, the larger/smaller comparators GK1–GK3, the coincidence comparators KV1–KV9, the and-gates UG1–UG3 and the or-gate OG are combined into a detection unit D indicated by the dashed line.

To avoid a delay in producing a car count, the circuits of FIGS. 15A, 15B and FIG. 16 do not measure the spacing between the last axle of the last car of a first train and the first axle of the first car of a subsequent train. Rather, when the spacing between axles exceeds a prescribed maximum, which is greater than the largest possible center axle spacing (e.g., 700 inches), the converter 94 or 98 supplies a signal on line L2 indicating this maximum spacing.

When the maximum spacing between axles is exceeded, a signal on line L2 sets flip flop SG which produces a signal on line L6 indicating the end of a train. When a new train is detected and a new axle spacing is applied to a register R via line L1, a threshold device SS recognizes the appearance of a regular axle spacing following a maximum spacing and resets the flip flop SG. This flip flop then produces a signal on line L5 indicating the presence of a train.

In order to control whether the number of established or fixed axles agrees with the selected car code, the detecting circuit is provided with an adding device AW which accumulates the number of axle spacings, including the maximum spacing, until a car detection signal is produced by the or-gate OG. The count in the adding device AW is then compared in a subtracting device SW with the respective car code, and the result of the comparison is produced on line L4. When this occurs, the adding device AW is reset into its initial, zero count position.

There has thus been shown and described a novel car detecting system which fulfills all the objects and advantages sought therefore. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which do not depart from the spirit and scope of the invention are deemed to be covered by the invention which is limited only by the claims which follow.

I claim:

1. Apparatus for identifying individual railroad cars among a train of railroad cars arranged on a track, wherein each car has two weight-bearing wheel trucks disposed beneath and at opposite ends thereof, each of said trucks having at least two axles arranged adjacent to each other such that the maximum distance between the axles of a single truck is less than the center distance between facing axles of the two trucks of a respective car, said apparatus comprising, in combination:

(a) means for measuring the distance between successive axles as a train of cars moves in one direction along the track;

(b) means, coupled to said distance measuring means, for comparing each measured distance with the maximum axle distance for a truck; and (c) means, coupled to said comparison means, for determining whether the axle spacing of a first truck equals the axle spacing of a second truck after the maximum axle distance for a truck has been exceeded;

whereby an individual car is identified upon identification of two identical truck assemblies which are separated by an axle spacing that is greater than said maximum axle distance.

2. The apparatus defined in claim 1, wherein said distance measuring means measures distance up to a given value.

3. The apparatus defined in claim 2, wherein said value is said maximum axle distance for a truck.

4. The apparatus defined in claim 1, wherein said distance measuring means measures distances down to a given value.

5. The apparatus defined in claim 4, wherein said given value is the minimum axle distance for a truck.

6. The apparatus defined in claim 1, wherein said distance measuring means includes a plurality of wheel sensors arranged along said track.

7. The apparatus defined in claim 1, wherein said distance measuring means includes a wheel sensor arranged along said track; means for determining the speed of a train of cars; and means, connected with said wheel sensor and said speed determining means, for computing the distance between successive axles from the times of successive actuation of said wheel sensor and said speed.

8. The apparatus defined in claim 1, wherein said comparing means and said determining means include a programmed microcomputer.

9. The apparatus defined in claim 1, further comprising means for detecting the presence of a train and means, coupled to said train detecting means, for inactivating said identifying apparatus when no train is present.

10. The apparatus defined in claim 1, further comprising means for determining the direction of movement of said train of cars; and means, connected to said direction determining means, for correcting said identifying apparatus when said direction is reversed.

11. The apparatus defined in claim 1, further comprising means for identifying a car by its axle spacing signature if the axle spacing of a first truck does not equal the axle spacing of a second truck after the maximum axle distance for a truck has been exceeded.

12. The apparatus defined in claim 1, wherein the center distance between facing axles of the two trucks of a car is less than a prescribed maximum, said apparatus further comprising means for determining whether an axle spacing exceeds said prescribed maximum, thereby to detect the end of a train.

13. The apparatus defined in claim 1, wherein said determining means includes a multi-digit shift register adapted to receive successive numbers corresponding to successive axle spacings, and a detecting device, connected to said register, for matching equal numbers in said register.

14. A method for identifying individual railroad cars among a train of railroad cars arranged on a track, wherein each car has two weight-bearing wheel trucks disposed beneath and at opposite ends thereof, each of said trucks having at least two axles arranged adjacent to each other such that the maximum distance between the axles of a single truck is less than the center distance between facing axles of the two trucks of a respective car, said method comprising the steps of:

(a) measuring the distance between successive axles as a train of cars moves in one direction along the track;

(b) comparing each measured distance with the maximum axle distance for a truck; and (c) determining whether the axle spacing of a first truck equals the axle spacing of a second truck after the maximum axle distance for a truck has been exceeded;

whereby an individual car is identified upon identification of two identical truck assemblies which are separated by an axle spacing that is greater than said maximum axle distance.

15. The method defined in claim 14, further comprising the step of identifying a car by its axle spacing signature if the axle spacing of a first truck does not equal the axle spacing of a second truck after the maximum axle distance for a truck has been exceeded.

* * * * *